United States Patent [19]

Mason et al.

[11] 4,161,061

[45] Jul. 17, 1979

[54] TERMINATION TOOL BLADE AND SLIDE APPARATUS

[75] Inventors: John R. Mason, Thousand Oaks; Donald L. Gregson, Paradise, both of Calif.

[73] Assignee: Dracon Industries, Chatsworth, Calif.

[21] Appl. No.: 807,441

[22] Filed: Jun. 17, 1977

[51] Int. Cl.[2] ..... H01R 43/00

[52] U.S. Cl. ..... 29/566.4; 29/278; 279/79; 285/314

[58] Field of Search ..... 279/77, 79, 81, 76, 279/80; 29/566.4, 278; 403/326, 327; 285/305, 314, 317; 7/14.1 R; 30/336, 338

[56] References Cited

U.S. PATENT DOCUMENTS

| | | | |
|---|---|---|---|
| 1,814,274 | 7/1931 | Williamson | 279/79 |
| 1,886,177 | 11/1932 | Gairing | 279/79 |
| 2,259,797 | 10/1941 | Cohen | 279/79 X |
| 3,883,316 | 5/1975 | Mason | 29/566.4 |
| 3,896,534 | 7/1975 | Kaufman et al. | 29/566.4 |

*Primary Examiner*—Gil Weidenfeld

*Attorney, Agent, or Firm*—Flehr, Hohbach, Test, Albritton & Herbert

[57] ABSTRACT

A reversible termination tool blade is removably interlocked in a slide by means of a spring loaded cam follower on the slide and a cam surface on the reversible termination blade. The blade is inserted in the slide with a rectilinear motion aligning the cam follower with the cam. A rotary motion of the blade in the slide causes the cam to pass the cam follower, capturing the cam follower behind the cam and interlocking the termination blade in the slide with the desired end of the termination blade projecting therefrom.

6 Claims, 5 Drawing Figures

TERMINATION TOOL BLADE AND SLIDE APPARATUS

BACKGROUND OF THE INVENTION

This invention is directed toward a blade for use in a termination tool, and more particularly to such a blade which is reversible and removably interlocking with the termination tool.

Termination tools for terminating electrical conductors at terminal blocks are widely used in the telephone industry. One such tool is described in U.S. Pat. No. 3,708,852, issued Jan. 9, 1973. This patent discloses a termination tool including a reversible steel blade attached by a single screw to means carried by a plastic handle. One end of the blade is for seating and cutting conductors at a terminal block, and the other end is for seating only. The blade retention screw is subject to loosening during use. Another such tool is described in U.S. Pat. No 3,883,316, issued May 13, 1975 which discloses a termination tool including a reversible steel blade attached by a single screw to means carried by a plastic handle. Again, one end of the blade is for seating and cutting conductors at a terminal block, and the other end is for seating only. In the termination tool described in the latter mentioned patent, a serrated portion of the reversible blade bears against the blade retention screw, reducing the tendency for the screw to loosen during use. In each of the foregoing patents, the blade retention screw must be released by backing it out of the termination tool. Thereafter the blade may be removed, reinserted in reverse orientation and the blade retention screw reinserted to obtain the desired function provided by the projecting end of the blade.

There is a need for a termination tool blade and assembly which does not loosen in the termination tool during use, and which may be quickly removed manually and replaced in the termination tool with the desired blade end extending therefrom.

SUMMARY AND OBJECTS OF THE INVENTION

A reversible blade for use with a termination tool is disclosed which is configured for removable interlocking engagement in the termination tool and for engaging a terminal clip. The reversible blade has a blade body with a seating edge on one end of the blade which is configured to engage the terminal clip, and a seating and cutting edge on the other end of the blade, which is also adapted to engage the terminal clip. A collar is formed on the blade body intermediate of the two ends. The collar has first and second detents formed therein, which are adapted to be engaged by the termination tool for interlocking the blade therein in one of two selected orientations.

In general it is an object of the present invention to provide a termination blade which is quickly removable manually from the termination tool, and which is quickly reinstalled manually in interlocked position in the termination tool.

Another object of the present invention is to provide a reversible termination blade and slide assembly for a termination tool which holds the termination blade securely in position for use, and which is easily removed therefrom and reinserted for storage and blade end selection.

Another object of the present invention is to provide a termination tool blade which does not loosen and change position in the tool during use.

Another object of the present invention is to provide a termination tool blade which snaps into and out of locked position in the termination tool manually.

Additional objects and features of the invention will appear from the following description in which the preferred embodiment has been set forth in detail in conjunction with the accompanying drawings.

DESCRIPTION OF THE PREFERRED EMBODIMENT

Figure 1:
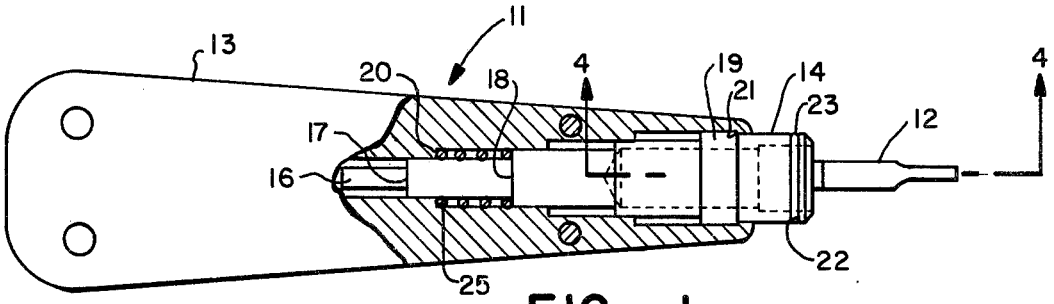
FIG. 1 is a partial sectional plan view of the termination tool and blade assembly.

FIG. 1 shows a termination tool 11 having a termination blade 12 extending therefrom. Termination tool 11 has a manually engageable handle 13 in which is contained a slide 14 which is movable longitudinally with respect to handle 13. Means are provided within handle 13 for delivering a striking blow or impact to slide 14. The means for delivering a striking blow may be of the type disclosed in U.S. Pat. No. 3,883,316.

Slide 14 has a pin-like projection 16 formed on one end, which functions as a trigger in conjunction with the means for delivering an impact to slide 14. A shoulder 17 surrounds the base of pin-like projection 16, functioning as an anvil to receive the striking blow or impact from the means for providing the same. A cylindrical portion of slide 14 extends from shoulder 17 to a reset spring seat 18. A land 19 surrounds slide 14, and engages an inner lip 21 in handle 13 to retain slide 14 therein. A reset spring 25 is disposed between reset spring seat 18 and an inner shoulder 20 in manually engagable handle 13. Reset spring 25 urges slide 14 outwardly from manually engagable handle 13 against inner lip 21 which limits the outward movement of slide 14. A cam follower spring retention groove 22 is formed near one end of slide 14 containing a cam follower spring 23 therein.

Figure 2:
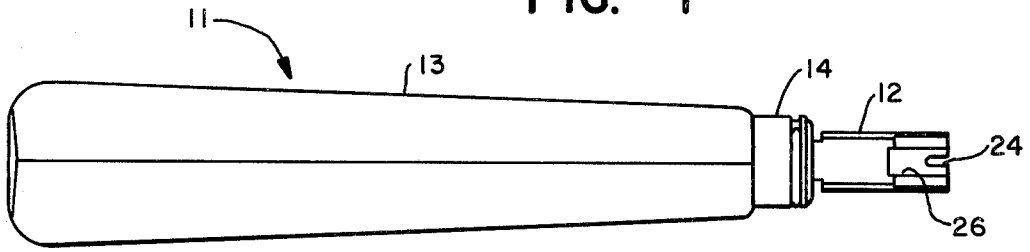
FIG. 2 is a side elevational view of the termination tool and blade assembly.

FIG. 2 shows a side elevational view of one end of a termination blade 12 having an elongated slot 24 and groove 26 formed therein, which conforms to the shape of a terminal located on a terminal block (not shown) used in terminating telephone conducting wires. Slide 14 is seen extending from one end of handle 13 in termination tool 11.

Figure 3:
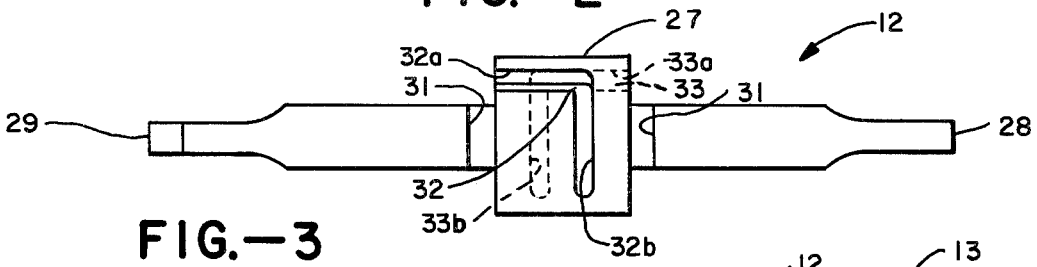
FIG. 3 is a plan view of the reversible termination blade.

FIG. 3 shows the termination blade 12 having a cylindrical collar 27 disposed between the two ends of the blade 12. A seating edge 28 is located on one end of termination blade 12, and a cutting and seating edge 29 is located on the other end. A slot 31 is formed adjacent to each end of cylindrical collar 27. An L-shaped slot 32 is formed on cylindrical collar 27 having one segment 32A extending lengthwise of termination blade 12 parallel to the axis of cylindrical collar 27, and having another segment 32B extending circumferentially on cylindrical collar 27. A second L-shaped slot 33 is shown on cylindrical collar 27, having one segment 33A extending parallel to the long axis of termination blade 12, and a second segment 33B extending circumferentially on cylindrical collar 27. L-shaped slots 32 and 33 are situated such that the ends of segments 32B and 33B are on opposite sides of cylindrical collar 27.

Figure 4:
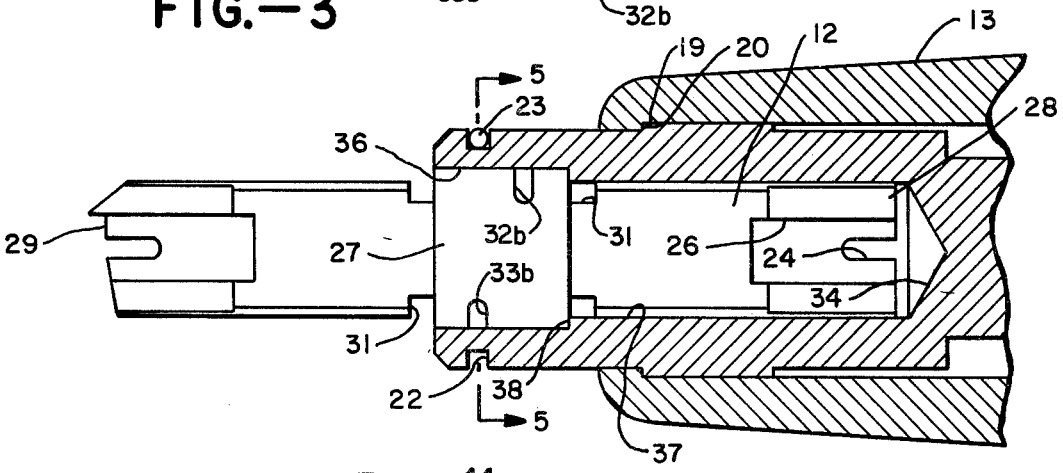
FIG. 4 is a sectional view along the line 4—4 of FIG. 1.

Turning to FIG. 4, the manner in which termination blade 12 is engaged by slide 14 is shown. Slide 14 has a bore 34 formed therein with a major diameter 36 and a minor diameter 37. Bore 34 contains a shoulder 38 between major and minor diameters 36 and 37 respectively. Bore 34 is formed to accept either end of termination blade 12 within minor diameter 37, and to accept and engage cylindrical collar 27 within major diameter 34. Slide 14 is seen with the edge of land 19 urged against the inner shoulder 21 on manually engagable handle 13.

FIG. 4 shows cam follower spring groove 22 containing cam follower spring 23 therein. Cam follower spring 23 extends into major diameter 36 of bore 34, as is hereinafter described in connection with FIG. 5. Slots 31 are provided so that the extension of cam follower spring 23 will clear the portions of termination blade 12 extending in either direction from cylindrical collar 27 when termination blade 27 is rotated in bore 34 prior to engagement of the extension of cam follower spring 23 in one of the lengthwise portions 32A or 33A of L-shaped slots 32 and 33. Termination blade 12 is shown in locked position within bore 34 of slide 14 in FIG. 4.

Figure 5:
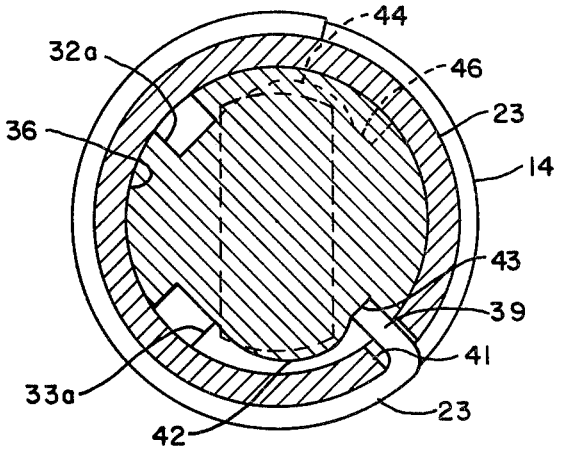
FIG. 5 is a sectional view along the line 5—5 of FIG. 4.

Turning now to FIG. 5, cam follower spring 23 is seen traversing more than 180° in cam follower spring groove 22. An extension 39 on cam follower spring 23 as mentioned above, is seen extending through a hole 41 in the bottom of cam follower spring groove 22. Extension 39 projects into major diameter 36 in bore 34. Segment 33B of L-shaped groove 33 has a cam surface 42 in the bottom thereof. A detent 43 is provided at the closed end of segment 33B in L-shaped slot 33. In like manner segment 32B of L-shaped slot 32 has a cam surface 44 in the bottom thereof, and a detent 46 at the closed end.

It may be seen that when termination blade 12 is placed within bore 34 with the desired end 29 extending outwardly therefrom, that blade 12 may be rotated until segment 33A of L-shaped groove 33 is aligned with the extension 39 on cam follower spring 23. Termination blade 12 may be rotated through 360° in bore 34 until such alignment is attained, by virtue of the clearance for extension 39 provided by slots 31 as mentioned above. When segment 33A is aligned with extension 39, termination blade 12 may be pushed inwardly into bore 34 until extension 39 contacts the junction between segments 33A and 33B of L-shaped groove 33. Subsequently a clockwise rotating movement of termination blade 12 is made, which causes cam surface 42 to displace extension 39 and cam follower spring 23 radially outward until detent 43 rests under the end of extension 39. The inwardly directed spring force exerted on extension 39 seats the extension in detent 43, thereby interlocking termination blade 12 with slide 14.

It is also clear that if termination blade 12 is subsequently rotated counterclockwise forcing cam surface 42 past the end of extension 39, the junction of segments 33A and 33B is again reached by extension 39. A lengthwise withdrawal of termination blade 12 from bore 34 may be thereafter made. In the event it is desired that seating edge 28 be allowed to extend from the end of slide 14, seating and cutting edge 29 is inserted into bore 34. Segment 32A of L-shaped groove 32 is thereafter aligned with extension 39 and termination blade 12 is pushed inwardly in slide 14 which accepts seating and cutting end 29 within bore 34. A clockwise motion imparted to termination blade 12 causes extension 39 to pass by cam surface 34 in segment 32B of L-shaped groove 32, to thereafter rest in detent 46. Termination blade 12 is thus easily inserted into slide 14 and interlocked therein by a lengthwise and rotary motion sequence imparted thereto. In like manner termination blade 12 is removed by a rotary and lengthwise motion sequence imparted thereto. Termination blade 12 when in the interlocked position within slide 14 is supported against sidewise directed loads by engagement of the sides of the cylindrical collar 27 on blade 12 within major diameter 36 of bore 34. It should further be noted that extension 39 and L-shaped groove 33 index seating and cutting edge 29 to orient the cutting edge on one side relative to manually engagable handle 13. As a consequence, when an electrical conductor is being seated in a terminal and one side is to be severed, it is unlikely that the tool will be used to sever the wrong side of the electrical conductor extending from the terminal by mistake.

It is envisioned that L-shaped grooves 32 and 33 may be replaced by straight grooves corresponding to segments 32A and 33A containing cam surfaces in the bottom thereof and detents at the closed ends of the grooves. Such a configuration would be manually interlocked and removed with simple linear motions of opposite sense.

It may be seen that a termination tool with a slide and termination blade combination has been disclosed which needs no screws to retain the reversible termination blade, provides a fail safe location index for the cutting edge of the blade, stores the unused end of the reversible blade, provides for quick manual interlock and removal of the blade from the slide, and provides capability for high lateral loads on the extended portion of the termination blade which is being used.

What is claimed:

1. A tool for terminating electrical conductors at a termination clip, comprising:

a manually engageable handle, a slide in said handle mounted for sliding lengthwise movement therein, means mounted in said handle for yieldably urging said slide outwardly therefrom, for limiting outward movement of said slide, and for impacting said slide, a termination blade, a termination end on said blade adapted to contact the termination clip, means disposed between said slide and said termination blade for removably interlocking said blade in one position with said slide, so that when the electrical conductor is positioned adjacent to the terminal clip and said termination end is forced thereagainst, the conductor is seated therein by the impact on said slide, said means for removably interlocking said blade to said slide including a cam follower member mounted on said slide being yieldably urged toward said termination blade, a cam surface on said termination blade aligned with said cam follower member, so that when said cam surface is forced past said cam follower member in one direction said termination blade is interlocked with said slide, and when said cam surface is forced in the opposite direction it is removable therefrom, a bore on the outward end of said slide formed to accept said termination blade, a cylindrical collar on said termination blade disposed to fit within said bore, said collar having an L-shaped groove on the surface thereof formed to accept said cam follower member, said L-shaped groove having one segment aligned with the collar cylindrical axis, and the other segment aligned circumferentially thereon, said cam surface being in the bottom of said circumferentially aligned groove segment, whereby an inward and rotary motion sequence of said blade in said slide with said cam follower member aligned with said one segment interlocks said blade and slide.

2. A blade for use in a termination tool of the type used to connect on electrical conductor to a terminal clip, and having a manually engageable handle, comprising a slide mounted in the handle disposed for lengthwise movement therein, a cam follower mounted on the slide, and means in the handle for impacting the slide, comprising a blade body engageable by the slide, a termination end on said blade body adapted to engage the terminal clip, a cam surface on said blade body having a low cam surface portion at one end thereof, so that when said blade body is engaged by the slide with the cam follower aligned with said cam surface, and said cam surface and cam follower are forced one past the other, said low cam surface portion captures said cam follower, whereby said blade body is interlocked with the slide, a collar on said blade body, said collar being displaced from said termination end and being engaged by the slide, said collar having an L-shaped groove therein adapted to accept the cam follower, one segment of said L-shaped groove being aligned with the width of said collar and the other segment of said L-shaped groove being aligned with the circumference thereof, said cam surface being at the bottom of said other segment, whereby a lengthwise and rotary motion sequence of said blade body relative to the slide positions the cam follower in said low cam surface portion.

3. A blade as in claim 2 wherein said blade body is reversible, said termination end being a seating end on one end thereof and a seating and cutting end on the other end thereof, an additional cam surface on said blade body having an additional low cam surface portion at one end thereof, so that when said low cam surface captures said cam follower said seating end projects from the slide and when said additional low cam surface captures said cam follower said seating and cutting end projects from the slide.

4. A blade as in claim 3 wherein said collar has an additional L shaped groove therein adapted to accept the cam follower, one segment of said additional L shaped groove being aligned with the width of said collar and the other segment of said additional L shaped groove being aligned with the circumference thereof, an additional cam surface at the bottom of said other additional L shaped groove segment having a low cam surface portion at one end thereof, said blade body being reversible, a seating edge on one end of said blade body, a seating and cutting edge on the other end of said blade body, so that when said cam follower is positioned in said low cam surface portion by said lengthwise and rotary motion sequence, said seating edge is at said termination end, and when said cam follower is positioned in said additional low cam surface portion by said lengthwise and rotary motion sequence a seating and cutting edge is at said termination end.

5. A tool for terminating electrical conductors at a termination clip, comprising a manually engageable handle, a slide in said handle mounted for sliding lengthwise movement therein, means mounted in said handle for yieldably urging said slide outwardly therefrom, for limiting outward movement of said slide, and for impacting said slide, a longitudinally extending reversible termination blade, a termination end on said blade adapted to contact the termination clip, said termination end being a seating end on one end thereof and being a seating and cutting end on the opposite end thereof, means disposed between said slide and said termination blade for removably interlocking said blade in only one predetermined position with said slide and said handle, so that when the electrical conductor is positioned adjacent to the terminal clip and said termination end is formed thereagainst, the conductor is seated therein by the impact on said slide, said means for removably interlocking comprising a spring member mounted on said slide being yieldably urged toward said termination blade, first and second cam surfaces and associated detents located at corresponding ends of said surfaces, said surfaces and detents located on said termination blade to cooperate with said spring member, each of said cam surfaces having a slope extending to its associated detent along a circumference of said blade in a plane normal to the longitudinal direction of said blade; so that when said first cam surface is forced past said spring member in one direction in said plane said termination blade is interlocked with said slide with said seating end projecting therefrom, and when said second cam surface is forced past said spring member in said one direction said termination blade is interlocked with said slide with said seating and cutting end projecting therefrom.

6. A tool as in claim 5 wherein said manually engageable handle includes an elongated non-cylindrical gripping portion.

* * * * *